United States Patent [19]

Lindstaedt et al.

[11] 4,079,528

[45] Mar. 21, 1978

[54] STEAM IRONS

[75] Inventors: Bernd Lindstaedt, Dietzenbach; Victor Enders, Salmunster, both of Germany

[73] Assignee: Rowenta-Werke, GmbH, Germany

[21] Appl. No.: 760,883

[22] Filed: Jan. 21, 1977

[30] Foreign Application Priority Data

Feb. 5, 1976 Germany ..... 2604393

[51] Int. Cl.[2] ..... D06F 75/06

[52] U.S. Cl. ..... 38/77.83

[58] Field of Search ..... 38/77.7, 77.83, 77.5

[56] References Cited

U.S. PATENT DOCUMENTS

| | | | |
|---|---|---|---|
| 3,675,351 | 7/1972 | Downing | 38/77.83 |
| 4,016,663 | 4/1977 | Cline et al. | 38/77.83 |

FOREIGN PATENT DOCUMENTS

| | | | |
|---|---|---|---|
| 1,353,447 | 1/1964 | France | 38/77.83 |
| 2,235,192 | 10/1973 | Germany | 38/77.83 |

*Primary Examiner*—Patrick D. Lawson

*Attorney, Agent, or Firm*—George R. Clark; Neil M. Rose; Clifford A. Dean

[57] ABSTRACT

A steam iron is provided with a feed valve to supply water to a vaporizing chamber. The feed valve comprises a valve member of metal which is encased in a plastics part, both the valve member and plastics part having a through flow aperture which supplies water to the vaporization chamber in response to operation of a valve stem. The said plastics part is so shaped and arranged that it extends into the vaporization chamber. In this way deposits of lime on the outer surface of the plastics part is avoided and movement of the valve stem in the aperture prevents lime deposits on the stem or in the aperture.

5 Claims, 1 Drawing Figure

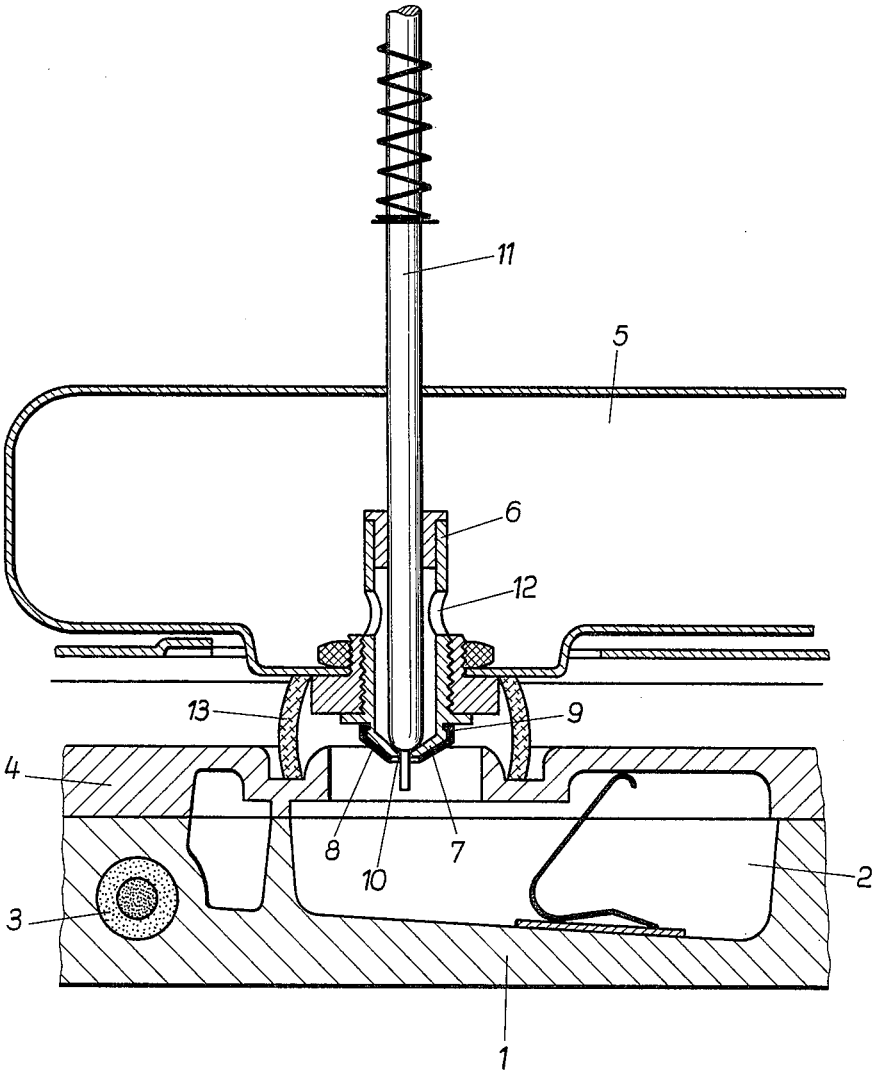
11
5
6
12
13
9
4
8
10
7
2
3
1

STEAM IRONS

This invention concerns steam irons and more particularly a feed valve for automatic steam irons which valve consists of a valve stem and valve member.

In automatic steam irons the quantity of water required for the steaming process is conveyed dropwise from a water tank into an electrically heated vaporisation chamber. The required metering is effected via a feed valve. Automatic steam irons are already known which use a valve member made of metal or a heat-resistant silicone rubber for the feed valve.

The valves have the disadvantage that valve members made of metal have a very great tendency to calcify on their outer surfaces and in the course of time the lime deposits take on such dimensions that the throughflow aperture becomes incrusted in a drop shape and can no longer be kept open even by the valve stem extending therethrough. Valve members made of silicone rubber have the disadvantage that in the course of time lime deposits on the valve stem enlarge the cross-section of the hole in the valve member when the feed valve is actuated and thus the quantity of water flowing through becomes so great that the heat capacity of the heater is no longer sufficient to vaporise the water present in the steam chamber and unvaporised drops of water emerge from the sole plate of the iron.

It is an object of this invention to provide a feed valve for a steam iron the individual parts of which present no surfaces for incrustation by lime precipitated upon vaporisation.

Accordingly the invention provides for a steam iron a metal valve member provided with a throughflow aperture which valve member is encased by a plastics part arranged to extend into the vaporisation chamber of a steam iron.

According to another aspect of the invention there is provided a steam iron having a water supply container and a vaporisation chamber communicating with each other through a feed valve which comprises a metal valve member encased in a plastics part, which extends into the vaporisation chamber, an aperture for water flow being provided through said metal valve member and said plastics part and a valve stem for regulating the flow of water through said aperture into said vaporisation chamber.

Preferably the plastics part and the valve member are connected to each other, and in one preferred embodiment of the invention, the valve member has an annular groove in which the plastics part is retained.

In this way it is ensured that, by using a metal valve member which is encased by a heat-resistant, water-repellent plastics part of constant shape, the deposit of lime on the outer surface is avoided and a constant throughflow quantity is maintained. On the other hand, lime deposits on the valve stem and in the throughflow aperture are prevented by the movement of the valve stem in the metal valve member. The quantity of water flowing through the valve is not reduced by an incrustation resulting from lime deposit. On the other hand, vaporisation residues have no opportunity of being deposited on the surface of the valve member facing the vaporisation chamber. Even over a long period of use, a valve according to the invention ensures that a constant quantity of steam is produced per unit of time.

One embodiment by way of example of the invention is shown in the accompanying drawings which show part of an automatic steam iron in cross-section. The drawing shows the valve region of the steam iron which has a sole plate 1, a vaporisation chamber 2 and a heater 3. The vaporisation chamber 2 is sealed off at the top by a cover portion 4, in the usual way. Above the vaporisation chamber 2 is mounted a water supply container 5 which is connected to the vaporisation chamber 2 via a feed valve 6. The feed valve 6 has a metal valve member 7 which is encased by a plastics part 8 which extends into the vaporisation chamber 2. The plastics part 8 is retained in an annular groove 9 in the valve chamber 7. The valve member 7 and the plastics part 8 are provided with a through aperture 10. The feed valve 6 is screwed to the water supply container 5. A valve stem 11 serves to open and close the throughflow aperture 10. Water inlet apertures 12 are provided in the valve member 7 inside the container 5. Between the water supply container 5 and the cover portion 4 the feed valve 6 is surrounded by an elastically deformable sleeve 13.

What we claim is:

1. A steam iron having a water supply container and a vaporisation chamber communicating with each other through a feed valve which comprises a metal valve member encased in a plastics part which extends into the vaporisation chamber, an aperture for water flow being provided through said metal valve member and said plastics part and a valve stem for regulating the flow of water through said aperture into said vaporisation chamber, said plastics part encasing the portion of said valve member outwardly and upwardly from said aperture to prevent the deposit of minerals on said valve member.

2. A steam iron as claimed in claim 1 wherein said plastics part and said valve member are connected together.

3. A steam iron as claimed in claim 1 wherein said valve member has an annular groove in its surface in which said plastics part is retained.

4. A steam iron having a water supply container and a vaporisation chamber communicating with each other through a feed valve comprising a metal valve member mounted in the bottom of said water supply container and extending into said vaporisation chamber, said valve member being formed with a centrally disposed passageway terminating at its lower end in a metering aperture, an elongated valve stem supported for lengthwise movement in said passageway and having one end in engagement with said valve member to close said aperture, a pin on said valve stem extending through said aperture to dislodge mineral deposits, a cup-shaped plastics part supported on said valve member to encase the portion within said vaporisation chamber, said plastics part having a central opening which is aligned with said aperture, said plastics part preventing the deposit of minerals on the exterior of said valve member.

5. The steam iron of claim 4 wherein said plastics part is formed with an inwardly extending flange on the top of the walls forming said cup shape, a groove extending around the outer periphery of said valve member, said flange being received in said groove to retain said plastics part assembled to said valve member.

* * * * *